US011448234B2

(12) United States Patent
Takase et al.

(10) Patent No.: US 11,448,234 B2
(45) Date of Patent: Sep. 20, 2022

(54) CENTRIFUGAL COMPRESSOR

(71) Applicant: KABUSHIKI KAISHA TOYOTA JIDOSHOKKI, Aichi-ken (JP)

(72) Inventors: Yohei Takase, Kariya (JP); Yoshiyuki Nakane, Kariya (JP); Satoru Mitsuda, Kariya (JP); Hiroaki Kato, Kariya (JP); Ryosuke Fukuyama, Kariya (JP); Daisuke Watanabe, Kariya (JP); Kaho Takeuchi, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/238,856

(22) Filed: Apr. 23, 2021

(65) Prior Publication Data

US 2021/0340993 A1 Nov. 4, 2021

(30) Foreign Application Priority Data

May 1, 2020 (JP) ..... JP2020-081287

(51) Int. Cl.
*F04D 17/10* (2006.01)
*F04D 29/42* (2006.01)
(Continued)

(52) U.S. Cl.
CPC ..... *F04D 29/426* (2013.01); *F04D 13/06* (2013.01); *F04D 17/10* (2013.01); *F04D 25/028* (2013.01); *F04D 25/0606* (2013.01); *F04D 29/043* (2013.01); *F04D 29/063* (2013.01); *F04D 29/083* (2013.01); *F04D 29/106* (2013.01); *F04D 29/22* (2013.01)

(58) Field of Classification Search
CPC .... F04D 17/10; F04D 25/028; F04D 25/0606; F04D 29/00–708
See application file for complete search history.

(56) References Cited

U.S. PATENT DOCUMENTS 9,982,687 B2 * 5/2018 Mitsuda ..... H02K 9/19
10,746,191 B2 * 8/2020 Fukuyama ..... F04D 29/102
(Continued)

FOREIGN PATENT DOCUMENTS

JP 2016-186238 10/2016
JP 2019-157707 9/2019

*Primary Examiner* — Brian P Wolcott
(74) *Attorney, Agent, or Firm* — Greenblum & Bernstein, P.L.C.

(57) ABSTRACT

First and second pressure relief passages extend from an oil pan in a branching manner, and merge with each other to form a merging portion. A pressure relief hole is arranged above the merging portion, and a first pressure relief passage is arranged below the merging portion. The minimum cross-sectional area of the second pressure relief passage is smaller than the minimum cross-sectional area of the first pressure relief passage. The second pressure relief passage includes a bent portion formed by bending the second pressure relief passage. The bent portion is configured to perform gas/liquid separation by crushing bubbles. When reaching the merging portion from the bent portion, oil is returned to the oil pan via the first pressure relief passage. When reaching the merging portion from the bent portion, gas is discharged to the outside of the housing via the pressure relief hole.

6 Claims, 4 Drawing Sheets

(51) Int. Cl.

| | |
|---|---|
| ***F04D 29/043*** | (2006.01) |
| ***F04D 29/10*** | (2006.01) |
| ***F04D 29/22*** | (2006.01) |
| ***F04D 13/06*** | (2006.01) |
| ***F04D 29/063*** | (2006.01) |
| ***F04D 29/08*** | (2006.01) |
| ***F04D 25/02*** | (2006.01) |
| ***F04D 25/06*** | (2006.01) |

(56) References Cited

U.S. PATENT DOCUMENTS

| | | | | |
|---|---|---|---|---|
| 10,760,584 | B2 * | 9/2020 | Fukuyama | F04D 25/06 |
| 10,767,655 | B2 * | 9/2020 | Fukuyama | F04D 25/0606 |
| 11,174,866 | B1 * | 11/2021 | Ito | F04D 25/028 |
| 11,221,013 | B2 * | 1/2022 | Nakane | F04D 29/06 |
| 11,286,944 | B2 * | 3/2022 | Fukuyama | F04D 25/02 |
| 2016/0281740 | A1 | 9/2016 | Mitsuda et al. | |
| 2018/0087520 | A1 * | 3/2018 | Snyder | F16N 13/22 |
| 2019/0277301 | A1 | 9/2019 | Fukuyama et al. | |
| 2021/0340993 | A1 * | 11/2021 | Takase | F04D 29/063 |

* cited by examiner

CENTRIFUGAL COMPRESSOR

BACKGROUND

1. Field

The present disclosure relates to a centrifugal compressor.

2. DESCRIPTION OF RELATED ART

Japanese Laid-Open Patent Publication No. 2016-186238 discloses a centrifugal compressor. The centrifugal compressor includes a low speed shaft, an impeller attached to a high speed shaft, and a speed increaser that transmits power from the low speed shaft to the high speed shaft. The centrifugal compressor further includes a housing and a dividing wall. The housing includes an impeller chamber, which accommodates the impeller, and a speed increaser chamber, which accommodates the speed increaser. The dividing wall divides the impeller chamber and the speed increaser chamber from each other. The dividing wall has an insertion hole through which the high speed shaft is passed. The centrifugal compressor also includes a seal member, an oil pan, and an oil passage. The seal member is provided between the outer circumferential surface of the high speed shaft and the inner circumferential surface of the insertion hole. The oil pan stores oil to be supplied to the speed increaser. The oil passage supplies oil stored in the oil pan to the speed increaser and returns the oil to the oil pan. The oil supplied to the speed increaser reduces friction and prevents seizure in sliding portions of the high speed shaft and the speed increaser. The seal member prevents leakage of the oil stored in the speed increaser chamber into the impeller chamber through the insertion hole.

When gas is compressed through rotation of the impeller, the internal pressure of the impeller chamber is increased. The compressed gas flows from the edge of the back face of the impeller to the clearance on the back face of the impeller. This increases the pressure of the clearance on the back face of the impeller. The gas may leak from the clearance on the back face of the impeller to the speed increaser chamber through the gap between the outer circumferential surface of the high speed shaft and the inner circumferential surface of the insertion hole, which may increase the pressure in the speed increaser chamber. Also, the pressure in the impeller chamber may become lower than the pressure in the speed increaser chamber, for example, when the impeller is rotating at a low speed or when the centrifugal compressor is in a stopped state. In this case, the oil in the speed increaser chamber may leak to the impeller chamber through the gap between the outer circumferential surface of the high speed shaft and the inner circumferential surface of the insertion hole.

For example, Japanese Laid-Open Patent Publication No. 2019-157707 discloses a centrifugal compressor that includes a pressure relief passage. The pressure relief passage connects an oil pan and the outside of the centrifugal compressor (the atmosphere side) to limit an increase in the pressure in the speed increaser chamber. This configuration releases pressure through the pressure relief passage if the pressure in the speed increaser chamber increases. This limits an increase in the pressure in the speed increaser chamber.

Since oil is supplied to the speed increaser, the oil accumulates in the speed increaser chamber. The oil accumulated in the speed increaser chamber is stirred by the speed increaser. This generates bubbles in the oil. The bubbles generated in the oil accumulate in the oil passage connected to the pressure relief passage, for example, of the oil pan. In the centrifugal compressor disclosed in Japanese Laid-Open Patent Publication No. 2019-157707, the oil pan and the outside of the housing are always connected to each other by the pressure relief passage. Accordingly, the oil stored in the oil pan may flow out to the pressure relief passage with bubbles contained, so that the bubbles may gush out from the pressure relief passage to the outside. This reduces the amount of oil supplied to the speed increaser.

SUMMARY

It is an objective of the present disclosure to provide a centrifugal compressor that is capable of limiting a reduction in the amount of oil supplied to a speed increaser.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a centrifugal compressor includes a low speed shaft that is rotated by a drive source, an impeller that is attached to a high speed shaft, which rotates at a speed higher than a speed of the low speed shaft, a speed increaser that transmits power of the low speed shaft to the high speed shaft, a housing, an oil pan, an oil passage, and a pressure relief passage. The housing that includes a drive source chamber that accommodates the drive source, an impeller chamber that accommodates the impeller, a speed increaser chamber that accommodates the speed increaser, and a dividing wall having an insertion hole through which the high speed shaft is passed. The dividing wall divides the impeller chamber and the speed increaser chamber from each other. The seal member is provided between an outer circumferential surface of the high speed shaft and an inner circumferential surface of the insertion hole. The oil pan stores oil supplied to the speed increaser. The oil passage supplies oil stored in the oil pan to the speed increaser, and returns the oil to the oil pan. The pressure relief passage connects the oil pan to a pressure relief hole that opens in an outer surface of the housing. The pressure relief passage includes a first pressure relief passage and a second pressure relief passage that extend from the oil pan in a branching manner. The second pressure relief passage merges with the first pressure relief passage to form a merging portion. The pressure relief hole is arranged above the merging portion in a direction of gravitational force. The first pressure relief passage is arranged below the merging portion in the direction of gravitational force. A minimum cross-sectional area of the second pressure relief passage is smaller than a minimum cross-sectional area of the first pressure relief passage. The second pressure relief passage includes a bent portion formed by bending the second pressure relief passage. The bent portion is configured to perform gas/liquid separation by crushing bubbles. When reaching the merging portion from the bent portion, oil is returned to the oil pan via the first pressure relief passage. When reaching the merging portion from the bent portion, gas is discharged to an outside of the housing via the pressure relief hole.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A centrifugal compressor 10 according to an embodiment will now be described with reference to FIGS. 1 to 5. The centrifugal compressor 10 of the present embodiment is mounted on a fuel cell vehicle that travels using a fuel cell as a power source. The centrifugal compressor 10 supplies air to the fuel cell. In the following description, the terms "upper," "upward," "above," "lower," "downward," "below," and other terms indicating vertical positional relationships are defined with reference to the direction of gravitational force.

Figure 1:
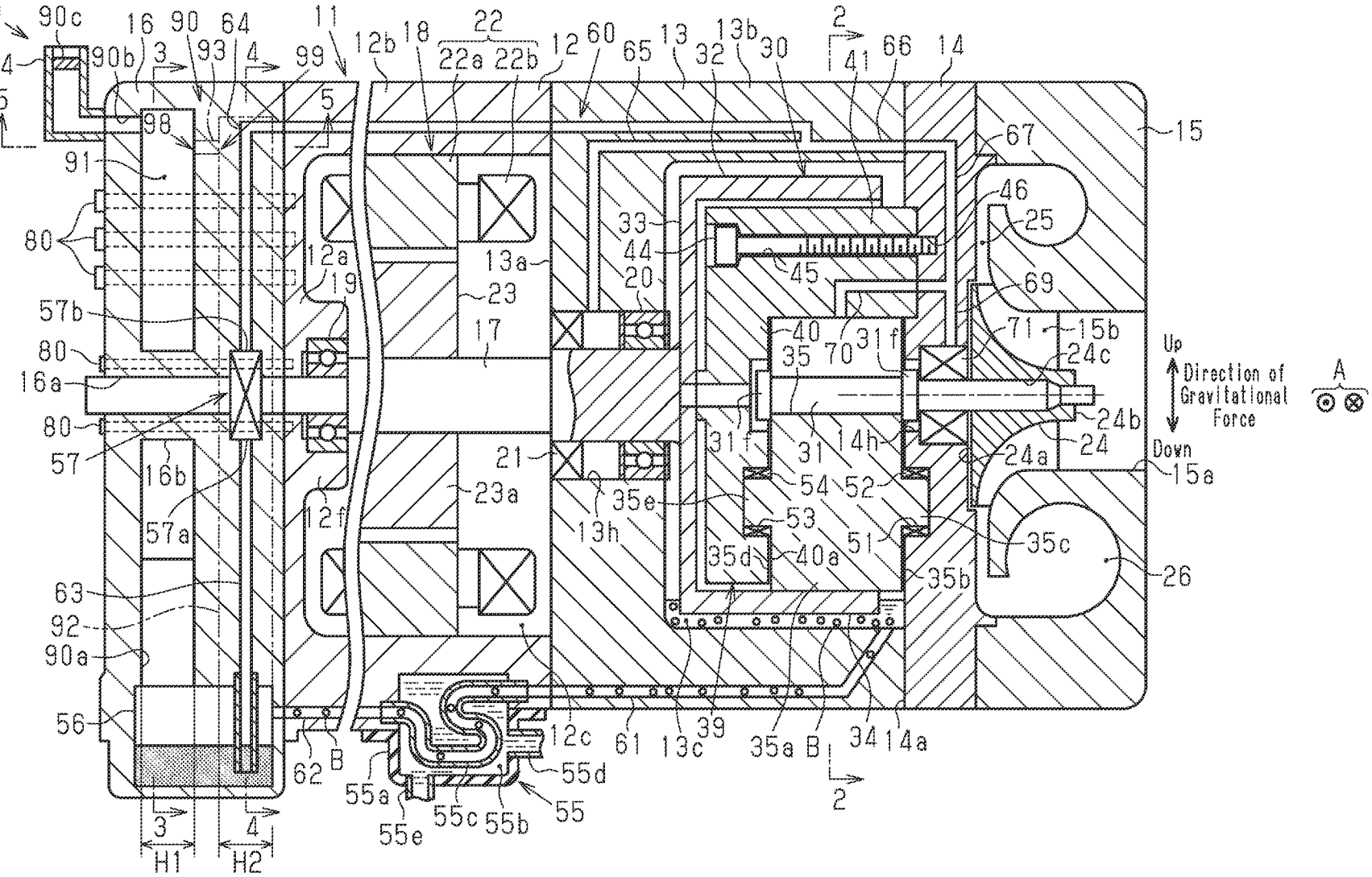
FIG. 1 is a cross-sectional side view showing a centrifugal compressor according to an embodiment.

As shown in FIG. 1, a housing 11 of the centrifugal compressor 10 includes a motor housing member 12, a speed increaser housing member 13, which is coupled to the motor housing member 12, a plate 14, which is coupled to the speed increaser housing member 13, a compressor housing member 15, which is coupled to the plate 14, and a rear housing member 16, which is coupled to the motor housing member 12 on a side opposite to the speed increaser housing member 13. The motor housing member 12, the speed increaser housing member 13, the plate 14, the compressor housing member 15, and the rear housing member 16 are made of metal such as aluminum. The housing 11 is substantially tubular. The rear housing member 16, the motor housing member 12, the speed increaser housing member 13, the plate 14, and the compressor housing member 15 are arranged in that order in the axial direction of the housing 11.

The motor housing member 12 includes a disc-shaped bottom wall 12*a* and a cylindrical peripheral wall 12*b*, which extends from the outer peripheral edge of the bottom wall 12*a*. The motor housing member 12 has a cylindrical shape with a closed end. The speed increaser housing member 13 includes a disc-shaped bottom wall 13*a* and a cylindrical peripheral wall 13*b*, which extends from the outer peripheral edge of the bottom wall 13*a*. The speed increaser housing member 13 has a cylindrical shape with a closed end.

An opening of the peripheral wall 12*b* on a side opposite to the bottom wall 12*a* is closed by the bottom wall 13*a* of the speed increaser housing member 13. The bottom wall 13*a* has a through-hole 13*h* in a center portion.

An opening of the peripheral wall 13*b* on a side opposite to the bottom wall 13*a* is closed by the plate 14. The plate 14 has an insertion hole 14*h* in a center portion.

The compressor housing member 15 is coupled to a surface of the plate 14 on a side opposite to the speed increaser housing member 13. The compressor housing member 15 includes a suction port 15*a*, through which air, which is fluid, is drawn in. The suction port 15*a* is located in a center portion of the end face of the compressor housing member 15 on the side opposite to the plate 14. The suction port 15*a* extends in the axial direction of the housing 11 from the center portion that end face of the compressor housing member 15.

The centrifugal compressor 10 includes an electric motor 18, which is a drive source, and a low speed shaft 17, which is rotated by the electric motor 18. The electric motor 18 is accommodated in the motor housing member 12. The housing 11 includes a motor chamber 12*c*, which is a drive source chamber accommodating the electric motor 18. The motor chamber 12*c* is defined by the inner surface of the bottom wall 12*a* and the inner circumferential surface of the peripheral wall 12*b* of the motor housing member 12, and the outer surface of the bottom wall 13*a* of the speed increaser housing member 13. The axial direction of the low speed shaft 17 agrees with the axial direction of the motor housing member 12. In this state, the low speed shaft 17 is accommodated in the motor housing member 12. The low speed shaft 17 is made of metal such as iron or an alloy.

The bottom wall 12*a* has a tubular boss 12*f* protruding from the inner surface. The low speed shaft 17 has a first end inserted into the boss 12*f*. A first bearing 19 is provided between the first end of the low speed shaft 17 and the boss 12*f*. The first end of the low speed shaft 17 is rotationally supported by the bottom wall 12*a* of the motor housing member 12 with the first bearing 19. The first end of the low speed shaft 17 extends through the bottom wall 12*a* of the motor housing member 12.

The low speed shaft 17 has a second end inserted into the through-hole 13*h*. A second bearing 20 is provided between the second end of the low speed shaft 17 and the through-hole 13*h*. The second end of the low speed shaft 17 is rotationally supported by the bottom wall 13*a* of the speed increaser housing member 13 with the second bearing 20. The low speed shaft 17 is thus rotationally supported by the housing 11. The second end of the low speed shaft 17 extends from the motor chamber 12*c* through the through-hole 13*h*, and protrudes into the speed increaser housing member 13.

A seal member 21 is provided between the second end of the low speed shaft 17 and the inner circumferential surface of the through-hole 13*h*. The seal member 21 is arranged between the second bearing 20 and the motor chamber 12*c*. The seal member 21 serves as a seal between the outer circumferential surface of the low speed shaft 17 and the inner circumferential surface of the through-hole 13*h*.

The rear housing member 16 is arranged to be adjacent to the motor housing member 12 in the axial direction of the low speed shaft 17. The rear housing member 16 is a block-shaped housing. The rear housing member 16 is coupled to the bottom wall 12*a* of the motor housing member 12. The rear housing member 16 has an insertion hole 16*a* into which the low speed shaft 17, which is passed through the bottom wall 12*a*, is inserted. The first end of the low speed shaft 17 extends through the rear housing member 16 and protrudes to the outside of the rear housing member 16.

The centrifugal compressor 10 includes bolts 80, which fasten the motor housing member 12 and the rear housing member 16 to each other. The bolts 80 extend through the rear housing member 16 in the axial direction of the low speed shaft 17, and threaded into the bottom wall 12*a* of the motor housing member 12, thereby fastening the motor housing member 12 and the rear housing member 16 to each other.

The electric motor 18 includes a tubular stator 22 and a rotor 23, which is arranged on the inner side of the stator 22. The rotor 23 is fixed to the low speed shaft 17 and rotates integrally with the low speed shaft 17. The stator 22 surrounds the rotor 23. The rotor 23 includes a cylindrical rotor core 23*a*, which is fixed to the low speed shaft 17, and permanent magnets (not shown), which are provided in the rotor core 23*a*. The stator 22 includes a tubular stator core 22*a* and a coil 22*b*. The stator core 22*a* is fixed to the inner circumferential surface of the peripheral wall 12*b* of the motor housing member 12. The coil 22*b* is wound about the stator core 22*a*. Current through the coil 22*b* causes the rotor 23 and the low speed shaft 17 to rotate integrally.

The centrifugal compressor 10 includes a high speed shaft 31, which rotates at a speed higher than that of the low speed shaft 17, and a speed increaser 30, which transmits power of the low speed shaft 17 to the high speed shaft 31. The housing 11 has a speed increaser chamber 13*c*, which accommodates the speed increaser 30. The speed increaser chamber 13*c* is defined by the inner surface of the bottom wall 13*a* and the inner circumferential surface of the peripheral wall 13*b* of the speed increaser housing member 13, and the plate 14. The speed increaser chamber 13*c* stores oil. The seal member 21 prevents leakage of oil stored in the speed increaser chamber 13*c* to the motor chamber 12*c* through the gap between the outer circumferential surface of the low speed shaft 17 and the inner circumferential surface of the through-hole 13*h*.

The high speed shaft 31 is made of metal such as iron or an alloy. The axial direction of the high speed shaft 31 agrees with the axial direction of the speed increaser housing member 13. In this state, a portion of the high speed shaft 31 is accommodated in the speed increaser chamber 13*c*. An end of the high speed shaft 31 that is on a side opposite to the motor housing member 12 extends through the insertion hole 14*h* of the plate 14 and protrudes into the compressor housing member 15. The axis of the high speed shaft 31 agrees with the axis of the low speed shaft 17.

The centrifugal compressor 10 includes an impeller 24, which is attached to the high speed shaft 31. The housing 11 has an impeller chamber 15*b*, which accommodates the impeller 24. The impeller chamber 15*b* is defined by the compressor housing member 15 and the plate 14. The plate 14 is a dividing wall that divides the impeller chamber 15*b* and the speed increaser chamber 13*c* from each other. The insertion hole 14*h*, through which the high speed shaft 31 is passed, is formed in the plate 14, which is a dividing wall. The housing 11 has the motor chamber 12*c*, which accommodates the electric motor 18, the impeller chamber 15*b*, which accommodates the impeller 24, and the speed increaser chamber 13*c*, which accommodates the speed increaser 30. The housing 11 also has the insertion hole 14*h*, through which the high speed shaft 31 is passed, and the plate 14, which divides the impeller chamber 15*b* and the speed increaser chamber 13*c* from each other.

The centrifugal compressor 10 includes a seal member 71 provided in the insertion hole 14*h*. The seal member 71 serves as a seal between the outer circumferential surface of the high speed shaft 31 and the inner circumferential surface of the insertion hole 14*h*. The seal member 71 is a mechanical seal. The seal member 71 prevents leakage of oil stored in the speed increaser chamber 13*c* to the impeller chamber 15*b* through the insertion hole 14*h*.

The impeller chamber 15*b* and the suction port 15*a* are connected to each other. The impeller chamber 15*b* is substantially truncated cone-shaped with its diameter gradually increasing as the distance from the suction port 15*a* increases. The high speed shaft 31 has an end that protrudes into the impeller chamber 15*b* in the compressor housing member 15.

The impeller 24 is tubular and has a diameter that gradually decreases from a proximal end face 24*a* toward a distal end face 24*b*. The impeller 24 has an insertion hole 24*c*, which extends in the axial direction of the impeller 24. The high speed shaft 31 can be passed through the insertion hole 24*c*. The end of the high speed shaft 31 that protrudes into the compressor housing member 15 is passed through the insertion hole 24*c*. The impeller 24 is attached to the high speed shaft 31 in this state. When the high speed shaft 31 rotates, the impeller 24 rotates, so that air drawn through the suction port 15*a* is compressed. The impeller 24 rotates integrally with the high speed shaft 31 to compress the air. The proximal end face 24*a* is an impeller back face.

Also, the centrifugal compressor 10 includes a diffuser passage 25, into which the air compressed by the impeller 24 flows, and a discharge chamber 26, into which the air that has passed through the diffuser passage 25 flows.

The diffuser passage 25 is defined by the surface of the compressor housing member 15 that is opposed to the plate 14 and the surface of the plate 14 that is opposed to the compressor housing member 15. The diffuser passage 25 is located outward of the impeller chamber 15*b* in the radial direction of the high speed shaft 31, surrounding the impeller chamber 15*b*. The diffuser passage 25 is annular.

The discharge chamber 26 is located outward of the diffuser passage 25 in the radial direction of the high speed shaft 31, and is connected to the diffuser passage 25. The discharge chamber 26 is annular. The impeller chamber 15*b* and the discharge chamber 26 are connected to each other by the diffuser passage 25. Air that has been compressed by the impeller 24 flows through the diffuser passage 25 to be compressed further, and flows to the discharge chamber 26 to be discharged from the discharge chamber 26.

The speed increaser 30 accelerates rotation of the low speed shaft 17 and transmits the rotation to the high speed shaft 31. The speed increaser 30 is of a traction drive type (a friction roller type). The speed increaser 30 includes a ring member 32, which is coupled to the second end of the low speed shaft 17. The ring member 32 is made of metal. The ring member 32 includes a disc-shaped base 33, which is coupled to the second end of the low speed shaft 17, and a tubular portion 34, which cylindrically extends from the outer edge of the base 33. The ring member 32 has a cylindrical shape with a closed end. The base 33 extends in the radial direction of the low speed shaft 17 with respect to the low speed shaft 17. The axis of the tubular portion 34 agrees with the axis of the low speed shaft 17.

Figure 2:
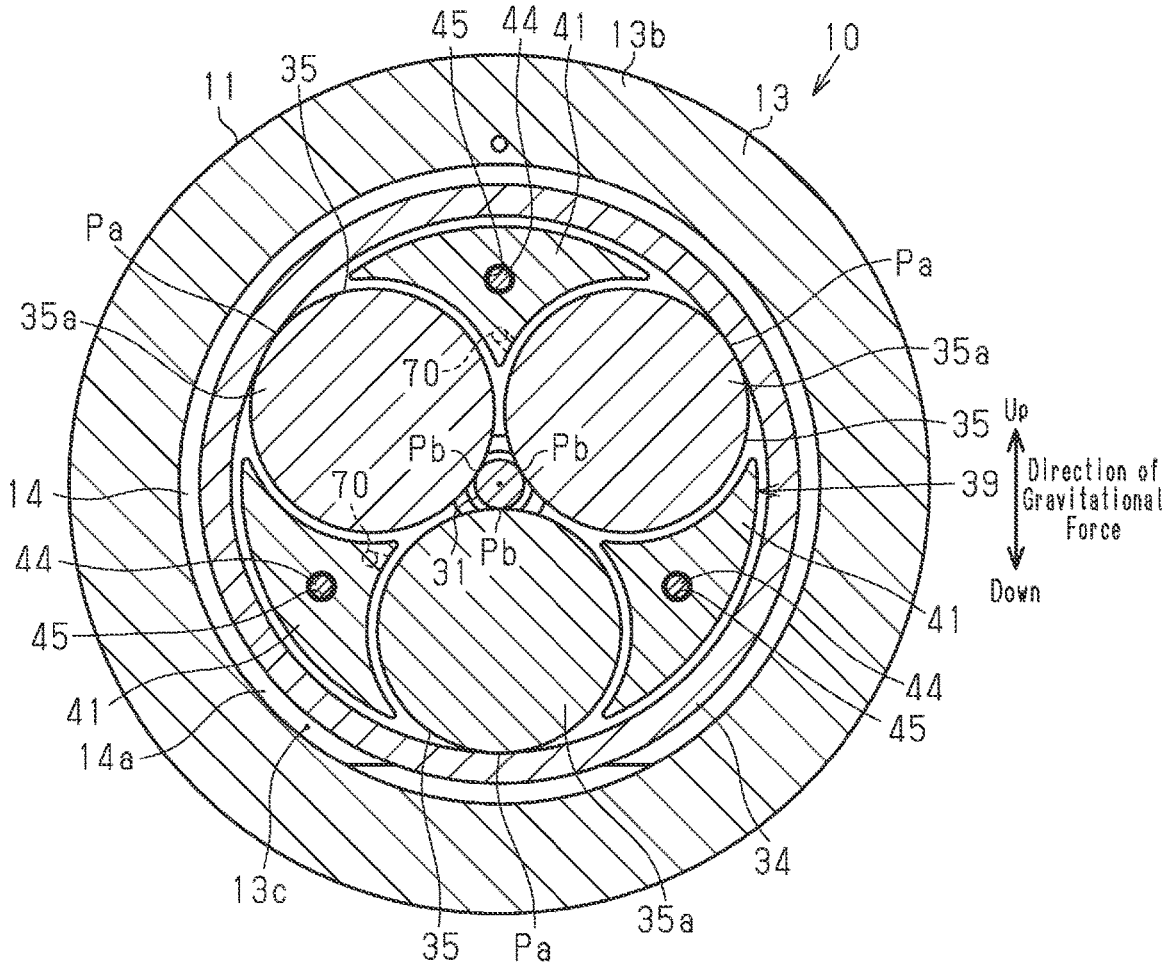
FIG. 2 is a cross-sectional view taken along line 2-2 in FIG. 1.

As shown in FIG. 2, part of the high speed shaft 31 is arranged inward of the tubular portion 34. The speed increaser 30 includes three rollers 35, which are provided between the tubular portion 34 and the high speed shaft 31. The three rollers 35 are made of metal, and, for example, are made of iron or an iron alloy that is the same metal as that of the high speed shaft 31. The three rollers 35 are arranged at predetermined intervals (for example, 120 degrees) in the circumferential direction of the high speed shaft 31. The three rollers 35 have the same shape. The three rollers 35 contact both of the inner circumferential surface of the tubular portion 34 and the outer circumferential surface of the high speed shaft 31.

As shown in FIG. 1, each roller 35 includes a columnar roller portion 35*a*, a columnar first protrusion 35*c*, and a columnar second protrusion 35*e*. The first protrusion 35*c* protrudes from a first end face 35*b* in the axial direction of the roller portion 35*a*. The second protrusion 35*e* protrudes from a second end face 35*d* in the axial direction of the roller portion 35*a*. The axis of the roller portion 35*a*, the axis of the first protrusion 35*c*, and the axis of the second protrusion 35*e* agree with one another. The axial direction of the roller portion 35*a* of each roller 35 and the axial direction of the high speed shaft 31 agree with each other.

As shown in FIGS. 1 and 2, the speed increaser 30 includes a support member 39, which cooperates with the plate 14 to rotationally support the rollers 35. The support member 39 is arranged inward of the tubular portion 34. The support member 39 includes a disc-shaped support base 40 and three pillar-shaped upright walls 41, which project from the support base 40. The support base 40 is arranged to be opposed to the plate 14 in the axial direction of the rollers 35. The three upright walls 41 extend toward the plate 14 from a surface 40*a* of the support base 40 that is closest to the plate 14. The three upright walls 41 are arranged so as to fill the three spaces, each of which is defined by the outer circumferential surfaces of adjacent two of the roller portions 35*a* and the inner circumferential surface of the tubular portion 34.

The support member 39 has three bolt insertion holes 45, through which bolts 44 are passed. Each bolt insertion hole 45 extends in the axial direction of the rollers 35 through corresponding one of the three upright walls 41. As shown in FIG. 1, the plate 14 has internal thread holes 46 in a surface 14*a* that is closest to the support member 39. The internal thread holes 46 are connected to the bolt insertion holes 45. The support member 39 is attached to the plate 14 by threading the bolts 44, which are passed through the bolt insertion holes 45, into the internal thread holes 46.

The plate 14 has three recesses 51 (only one of the recesses 51 is shown in FIG. 1) in the surface 14*a* that is closest to the support member 39. The three recesses 51 are arranged at predetermined intervals (for example, 120 degrees) in the circumferential direction of the high speed shaft 31. The positions of the three recesses 51 respectively correspond to the positions of the three rollers 35. The three recesses 51 each receive an annular roller bearing 52.

The support base 40 has three recesses 53 (only one of the recesses 53 is shown in FIG. 1) in the surface 40*a* that is closest to the plate 14. The three recesses 53 are arranged at predetermined intervals (for example, 120 degrees) in the circumferential direction of the high speed shaft 31. The positions of the three recesses 53 respectively correspond to the positions of the three rollers 35. The three recesses 53 each receive an annular roller bearing 54.

The first protrusion 35*c* of each roller 35 is inserted into the roller bearing 52 in the corresponding recess 51, and is rotationally supported by the plate 14 with the roller bearing 52. The second protrusion 35*e* of each roller 35 is inserted into the roller bearing 54 in the corresponding recess 53, and is rotationally supported by the support member 39 with the roller bearing 54.

The high speed shaft 31 includes two flanges 31*f*, which are arranged at positions spaced apart to be opposed to each other in the axial direction of the high speed shaft 31. The roller portions 35*a* of the three rollers 35 are held by the two flanges 31*f*. This prevents positional displacement of the high speed shaft 31 and the roller portions 35*a* of the three rollers 35 in the axial direction of the high speed shaft 31.

As shown in FIG. 2, the three rollers 35 are pressed against the high speed shaft 31 and the tubular portion 34. The three rollers 35, the ring member 32, and the high speed shaft 31 are unitized in this state. The high speed shaft 31 is rotationally supported by the three rollers 35.

The contacting section between the outer circumferential surface of the roller portion 35*a* of each of the three rollers 35 and the inner circumferential surface of the tubular portion 34 is referred to as a ring-side contacting section Pa, to which pressing load is applied. The contacting section between the outer circumferential surface of each of the three rollers 35 and the outer circumferential surface of the high speed shaft 31 is referred to as a shaft-side contacting section Pb, to which pressing load is applied. The ring-side contacting sections Pa and the shaft-side contacting sections Pb extend in the axial direction of the high speed shaft 31.

When the electric motor 18 operates to rotate the low speed shaft 17 and the ring member 32, the rotational force of the ring member 32 is transmitted to the three rollers 35 via the ring-side contacting sections Pa. When the three rollers 35 rotate, the rotational force of the three rollers 35 is transmitted to the high speed shaft 31 via the shaft-side contacting sections Pb. Accordingly, the high speed shaft 31 rotates. At this time, the ring member 32 rotates at the same speed as that of the low speed shaft 17, and the three rollers 35 rotate at a speed higher than that of the low speed shaft 17. The high speed shaft 31, which has an outer diameter smaller than that of the outer diameter of the three rollers 35, rotates at a speed higher than that of the three rollers 35. That is, the speed increaser 30 causes the high speed shaft 31 to rotate at a speed higher than that of the low speed shaft 17.

As shown in FIG. 1, the centrifugal compressor 10 includes an oil pan 56, an oil passage 60, an oil cooler 55, and an oil pump 57. The oil pan 56 stores oil supplied to the speed increaser 30. The oil passage 60 supplies oil stored in the oil pan 56 to the speed increaser 30, and returns the oil to the oil pan 56. The oil cooler 55 cools oil flowing to the oil passage 60. The oil pump 57 pumps the oil stored in the oil pan 56 and discharges the oil.

The oil cooler 55 includes a cover member 55*a*, which has a tubular shape with a closed end, and is attached to the outer circumferential surface of the peripheral wall 12*b* of the motor housing member 12. The inner surface of the cover member 55*a* and the outer circumferential surface of the peripheral wall 12*b* of the motor housing member 12 define a space 55*b*. The oil cooler 55 includes a cooling pipe 55*c*, which is arranged in the space 55*b*. The opposite ends of the cooling pipe 55*c* are supported by the motor housing member 12. The cooling pipe 55*c* forms part of the oil passage 60.

The cover member 55*a* includes an inlet pipe 55*d* and an outlet pipe 55*e*. Low-temperature fluid is introduced into the space 55*b* through the inlet pipe 55*d*. The low-temperature fluid that is introduced into the space 55*b* is drained from the outlet pipe 55*e*, and is then cooled by a cooling device (not shown). Thereafter, the low-temperature fluid is introduced into the space 55*b* through the inlet pipe 55*d* again. The low-temperature fluid is, for example, water.

The oil pan 56 is provided in the rear housing member 16. The oil pan 56 is located in an outer part of the rear housing member 16. The oil pump 57 is located in the rear housing member 16. The oil pump 57 is, for example, a trochoid pump. The oil pump 57 is coupled to the first end of the low speed shaft 17. The oil pump 57 is driven by rotation of the low speed shaft 17. The oil pump 57 is fixed in the rear housing member 16 by three of the bolts 80 (shown in FIG. 3).

The oil passage 60 includes a first connection passage 61, which connects the speed increaser chamber 13*c* and the oil cooler 55 to each other. The first connection passage 61 extends through the speed increaser housing member 13 and into the peripheral wall 12*b* of the motor housing member 12. The first connection passage 61 has a first end, which opens in the speed increaser chamber 13*c*. The first connection passage 61 has a second end, which is connected to the first end of the cooling pipe 55*c*.

The centrifugal compressor 10 is mounted on the fuel cell vehicle such that the opening of the first connection passage 61 that opens in the speed increaser chamber 13*c* is located in the lower part. The oil in the speed increaser chamber 13*c* thus flows into the first connection passage 61.

The oil passage 60 includes a second connection passage 62, which connects the oil cooler 55 and the oil pan 56 to each other. The second connection passage 62 has a first end, which extends from the inside of the motor housing member 12 and into the rear housing member 16. The first end of the second connection passage 62 is connected to the second end of the cooling pipe 55*c*. The second connection passage 62 has a second end, which opens in the oil pan 56.

The oil stored in the speed increaser chamber 13*c* flows into the first connection passage 61 and passes through the first connection passage 61, the cooling pipe 55*c*, and the second connection passage 62. The oil that passes through the cooling pipe 55*c* is cooled through heat exchange with low-temperature fluid drawn into the space 55*b* of the oil cooler 55. The oil cooled by the oil cooler 55 is stored in the oil pan 56.

The oil passage 60 includes a third connection passage 63, which connects the oil pan 56 and the oil pump 57 to each other. The third connection passage 63 is formed in the rear housing member 16. The third connection passage 63 has a first end, which protrudes into the oil pan 56. The third connection passage 63 has a second end, which is connected to a suction port 57*a* of the oil pump 57.

The oil passage 60 includes a fourth connection passage 64, which is connected to a discharge port 57*b* of the oil pump 57. The fourth connection passage 64 extends through the rear housing member 16 and the peripheral wall 12*b* of the motor housing member 12, and into the peripheral wall 13*b* of the speed increaser housing member 13. The fourth connection passage 64 has a first end, which is connected to the discharge port 57*b* of the oil pump 57. The fourth connection passage 64 has a second end, which is located inside the peripheral wall 13*b* of the speed increaser housing member 13.

The oil passage 60 includes a first branch passage 65 and a second branch passage 66, which branch from the second end of the fourth connection passage 64. The first branch passage 65 extends toward the motor housing member 12 from the second end of the fourth connection passage 64, and extends through the peripheral wall 13*b* of the speed increaser housing member 13 and the bottom wall 13*a* of the speed increaser housing member 13. The first branch passage 65 has a first end, which is connected to the second end of the fourth connection passage 64. The first branch passage 65 has a second end, which opens in the through-hole 13*h*.

The second branch passage 66 extends toward the plate 14 from the second end of the fourth connection passage 64, and extends through the peripheral wall 13*b* of the speed increaser housing member 13 and into the plate 14. The second branch passage 66 has a first end, which is connected to the second end of the fourth connection passage 64. The second branch passage 66 has a second end, which is located inside the plate 14.

The oil passage 60 includes a common passage 67, which is connected to the second end of the second branch passage 66. The common passage 67 extends perpendicular to the second branch passage 66, and extends downward linearly from the second end of the second branch passage 66. The oil passage 60 includes a seal member-side supply passage 69 and a speed increaser-side supply passages 70, which branch from the common passage 67. The seal member-side supply passage 69 has a first end, which is connected to the common passage 67. The seal member-side supply passage 69 has a second end, which opens in the insertion hole 14*h*. Each speed increaser-side supply passage 70 extends linearly from the common passage 67 to a side opposite to the compressor housing member 15 and through the plate 14. Each speed increaser-side supply passage 70 extends through the corresponding upright wall 41 and opens in a section of the upright wall 41 that is opposed to the outer circumferential surfaces of the roller portions 35*a*. The speed increaser-side supply passages 70 are thus connected to the speed increaser chamber 13*c*.

When the electric motor 18 is activated, rotation of the low speed shaft 17 drives the oil pump 57. Then, the oil stored in the oil pan 56 is drawn into the oil pump 57 through the third connection passage 63 and the suction port 57*a*, and discharged to the fourth connection passage 64 through the discharge port 57*b*. The oil pump 57 is driven such that, as the rotation speed of the low speed shaft 17 increases, the amount of oil discharged from the discharge port 57*b* increases proportionally. The oil discharged to the fourth connection passage 64 flows through the fourth connection passage 64 to be distributed to the first branch passage 65 and the second branch passage 66.

The oil distributed to the first branch passage 65 from the fourth connection passage 64 flows through the first branch passage 65 and into the through-hole 13*h* to be supplied to the seal member 21 and the second bearing 20. This ensures favorable lubrication of the sliding portions of the seal member 21 and the low speed shaft 17, and the sliding portions of the second bearing 20 and the low speed shaft 17.

The oil distributed to the second branch passage 66 from the fourth connection passage 64 flows into the common passage 67 via the second branch passage 66. Some of the oil that flows in the common passage 67 is distributed to the seal member-side supply passage 69, and the remaining oil flows in the speed increaser-side supply passages 70. The oil that is distributed to the seal member-side supply passage 69 from the common passage 67 flows in the seal member-side supply passage 69 to flow into the insertion hole 14*h* to be supplied to the seal member 71. The oil that flows in the speed increaser-side supply passages 70 is supplied to the outer circumferential surfaces of the roller portions 35*a*. This ensures favorable lubrication of the sliding portions of the roller portions 35*a* and the high speed shaft 31. The oil supplied to the seal member 71 and the outer circumferential surfaces of the roller portions 35*a* is returned to the speed increaser chamber 13*c*.

The centrifugal compressor 10 includes a pressure relief hole 90*b*, which opens in the outer surface of the housing 11, and a pressure relief passage 90, which connects the pressure relief hole 90*b* and the upper part of the oil pan 56.

Figure 4:
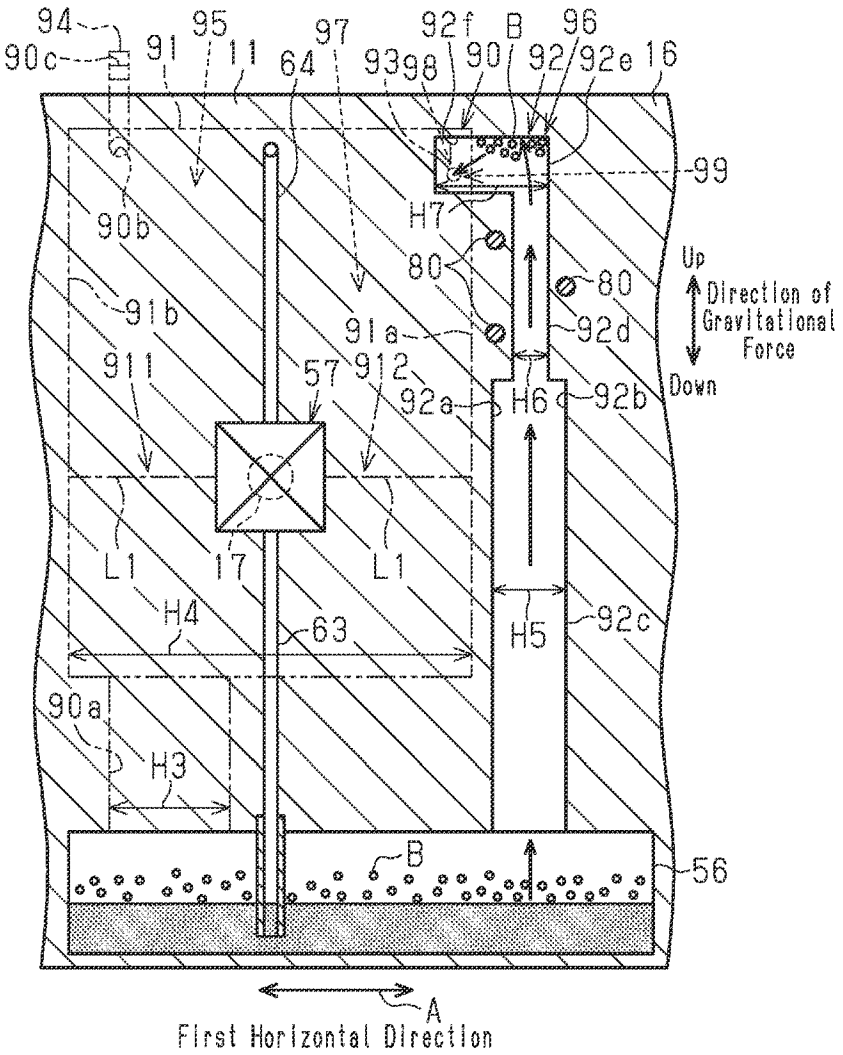
FIG. 4 is a cross-sectional view taken along line 4-4 in FIG. 1.
Figure 3:
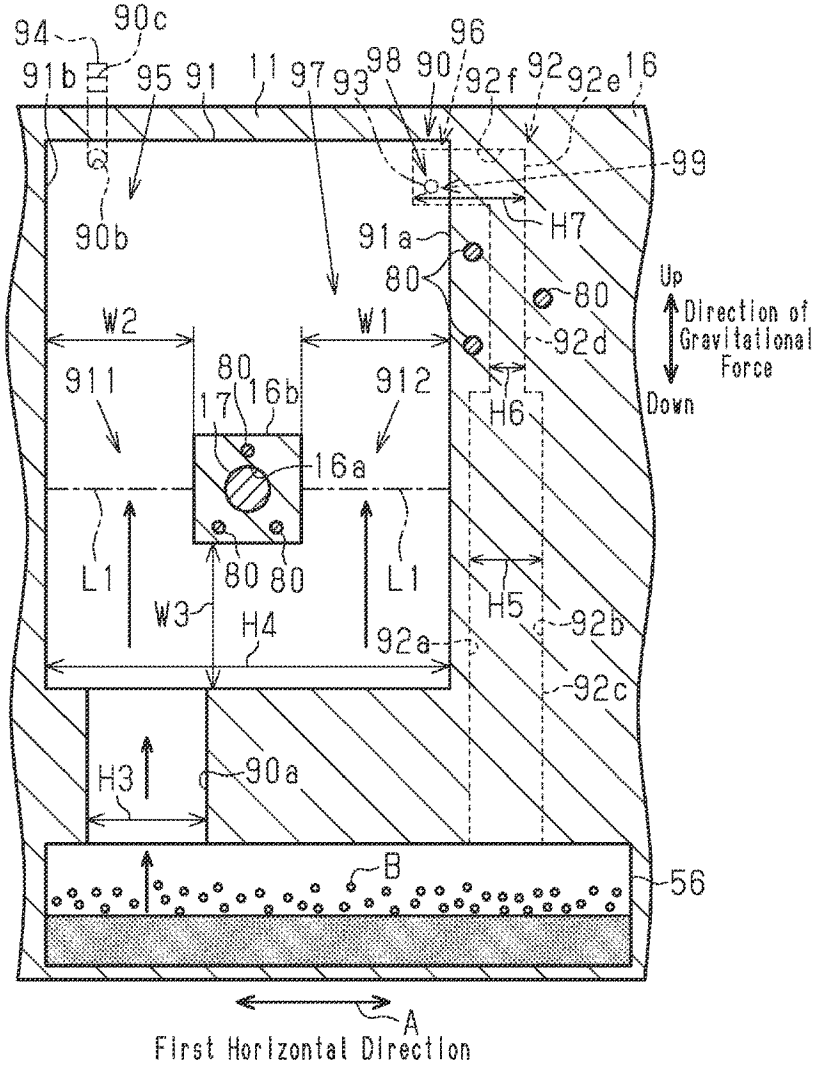
FIG. 3 is a cross-sectional view taken along line 3-3 in FIG. 1.

As shown in FIGS. 1, 3, and 4, the pressure relief passage 90 includes a connection passage 90*a*, a first buffer chamber 91, a second buffer chamber 92, and a communicating passage 93. The connection passage 90*a*, the first buffer chamber 91, the second buffer chamber 92, and the communicating passage 93 are formed in the rear housing member 16.

The first buffer chamber 91 is arranged above the oil pan 56. The first buffer chamber 91 has a rectangular shape extending in the direction of gravitational force when viewed in the axial direction of the low speed shaft 17 and in the radial direction of the low speed shaft 17. The connection passage 90*a* connects the oil pan 56 and the first buffer chamber 91 to each other. The connection passage 90*a* has a first end, which opens in the upper part in the oil pan 56. The connection passage 90*a* has a second end, which opens in the lower part in the first buffer chamber 91. The connection passage 90*a* has a rectangular shape extending in the direction of gravitational force when viewed in the axial direction of the low speed shaft 17 and in the radial direction of the low speed shaft 17. As shown in FIG. 1, in the axial direction of the low speed shaft 17, the width of the connection passage 90*a* and the width of the first buffer chamber 91 are the same (a width H1). In the axial direction of the low speed shaft 17, the position of the connection passage 90*a* and the position of the first buffer chamber 91 agree with each other. As shown in FIG. 3, in the radial direction of the low speed shaft 17, a width H3 of the connection passage 90*a* is smaller than a width H4 of the first buffer chamber 91.

As shown in FIGS. 1, 3, and 4, the second buffer chamber 92 is connected to the oil pan 56. The second buffer chamber 92 extends upward from the oil pan 56 and is parallel with the first buffer chamber 91. The second buffer chamber 92 extends to a height comparable to the height of the first buffer chamber 91 in the direction of gravitational force.

Among the horizontal directions, which are perpendicular to the direction of gravitational force, a direction that is perpendicular to the low speed shaft 17 is defined as a first horizontal direction A. As shown in FIG. 1, the second buffer chamber 92 has a rectangular shape extending in the direction of gravitational force when viewed in the first horizontal direction A. In the axial direction of the low speed shaft 17, a width H2 of the second buffer chamber 92 is the same as the width H1 of the connection passage 90*a* and the first buffer chamber 91.

The connection passage 90*a* and the first buffer chamber 91 are displaced from the second buffer chamber 92 in the axial direction of the low speed shaft 17. The second buffer chamber 92 is arranged between the first buffer chamber 91 and the motor housing member 12 in the axial direction of the low speed shaft 17.

As shown in FIGS. 3 and 4, the first buffer chamber 91 and the second buffer chamber 92 are displaced from each other in the first horizontal direction A when viewed in the axial direction of the low speed shaft 17.

The housing 11 has a first side surface 91*a* and a second side surface 91*b*, which are opposed to each other in the first horizontal direction A and define the first buffer chamber 91. The first side surface 91*a* is located closest to the second buffer chamber 92, and the second side surface 91*b* is located on a side opposite to the second buffer chamber 92. The housing 11 has a first side surface 92*a* and a second side surface 92*b*, which are opposed to each other in the first horizontal direction A and define the second buffer chamber 92. When the second buffer chamber 92 is viewed in the axial direction of the low speed shaft 17, the second buffer chamber 92 is adjacent to the first side surface 91*a* in the first horizontal direction A. When the second buffer chamber 92 is viewed in the axial direction of the low speed shaft 17, the first side surface 92*a* is adjacent to the first side surface 91*a* in the first horizontal direction A. In the first horizontal direction A, the second side surface 92*b* is on the side opposite to the first buffer chamber 91.

As shown in FIGS. 1, 3, and 4, the communicating passage 93 connects the first buffer chamber 91 and the second buffer chamber 92 to each other. The communicating passage 93 connects the upper part of the first buffer chamber 91 and the upper part of the second buffer chamber 92 to each other. The communicating passage 93 extends in the axial direction of the low speed shaft 17.

As shown in FIGS. 1 and 3, a rectangular pillar-shaped protrusion 16*b* is arranged in the first buffer chamber 91. The protrusion 16*b* has an insertion hole 16*a*, through which the low speed shaft 17 is passed. In the first buffer chamber 91, the protrusion 16*b* is arranged to connect two inner walls that are opposed to each other in the axial direction of the low speed shaft 17. The protrusion 16*b* is formed integrally with the two inner walls.

As shown in FIG. 3, the protrusion 16*b* is located halfway between the first side surface 91*a* and the second side surface 91*b* in the first horizontal direction A. The protrusion 16*b* is located between the upper part of the first buffer chamber 91 and the lower part of the first buffer chamber 91. The protrusion 16*b* is arranged at a position below the center of the first buffer chamber 91 in the direction of gravitational force.

The cross section of the protrusion 16*b* when cut in the radial direction of the low speed shaft 17 is square. The width of the space between the first side surface 91*a* and a side surface of the protrusion 16*b* that is opposed to the first side surface 91*a* is defined as a width W1. The width of the space between the second side surface 91*b* and a side surface of the protrusion 16*b* that is opposed to the second side surface 91*b* is defined as a width W2. The width W1 and the width W2 are equal to each other. The width of the space between the lower part of the first buffer chamber 91 and a side surface of the protrusion 16*b* that is opposed to the lower part of first buffer chamber 91 is defined as a width W3. The width W3 is the same as the widths W1, W2. The widths W1, W2, W3 are larger than the width H3 of the connection passage 90*a*.

The first buffer chamber 91 includes a first passage 911 formed between the protrusion 16*b* and the second side surface 91*b*. The first buffer chamber 91 includes a second passage 912. The second passage 912 includes a passage formed between the protrusion 16*b* and the lower part of the first buffer chamber 91, and a passage formed between the protrusion 16*b* and the first side surface 91*a*. The lower part of the first passage 911 is connected to the connection passage 90*a*. The second passage 912 extends from the first passage 911 toward the first side surface 91*a* and extends upward, detouring the protrusion 16*b*. The first passage 911 and the second passage 912 are connected to each other in a region in the first buffer chamber 91 that is above the protrusion 16*b*. The first passage 911 and the second passage 912 share the region in the first buffer chamber 91 that is above the protrusion 16*b*. Three of the bolts 80 that fasten the motor housing member 12 and the rear housing member 16 together are passed through the protrusion 16*b*.

As shown in FIG. 1, the pressure relief hole 90*b* is formed in the wall of the rear housing member 16 that is on the side opposite to the motor housing member 12. The pressure relief hole 90*b* has a first end, which opens in the upper part in the first buffer chamber 91. The pressure relief hole 90*b* has a second end, which opens in the outer surface of the rear housing member 16. That is, the first buffer chamber 91 is connected to the outer surface of the housing 11 via the pressure relief hole 90*b*.

The pressure relief hole 90*b* is formed to extend in the axial direction of the low speed shaft 17. A pressure relief pipe 94 is provided on the outer surface of the rear housing member 16 in which the pressure relief hole 90*b* opens. The pressure relief pipe 94 is a tubular member that is bent in an L-shape. The pressure relief pipe 94 has a first end, which is connected to the pressure relief hole 90*b*. The pressure relief pipe 94 has a second end, which is located above the first end of the pressure relief pipe 94 and opens upward. A ventilation film 90*c* is arranged in the second end of the pressure relief pipe 94. The ventilation film 90*c* allows passage of gas but blocks liquid.

As shown in FIGS. 3 and 4, the connection passage 90*a*, the first passage 911, and the region in the first buffer chamber 91 that is above the protrusion 16*b* form a first pressure relief passage 95. The pressure relief passage 90 thus includes the first pressure relief passage 95. The pressure relief hole 90*b* is provided in the upper part of the first pressure relief passage 95.

The second passage 912 and the region in the first buffer chamber 91 that is above the protrusion 16*b* form a detouring pressure relief passage 97. The pressure relief passage 90 thus includes the detouring pressure relief passage 97. The first passage 911 and the second passage 912 share a region in the upper part in the first buffer chamber 91. Therefore, the detouring pressure relief passage 97 extends from the lower part of the first pressure relief passage 95 to the region above the protrusion 16*b*, detouring the protrusion 16*b*.

The second buffer chamber 92 and the communicating passage 93 form a second pressure relief passage 96. The pressure relief passage 90 thus includes the second pressure relief passage 96. The second pressure relief passage 96 is connected, by the communicating passage 93, to the upper region in the first buffer chamber 91 that is close to the first side surface 91*a*. The first pressure relief passage 95 and the second pressure relief passage 96 extend from the oil pan 56 in a branching manner. The second pressure relief passage 96 merges with the first pressure relief passage 95 to form a merging portion 98. The merging portion 98 refers to a connection portion at which the first buffer chamber 91 and the communicating passage 93 are connected to each other.

The first pressure relief passage 95 and the detouring pressure relief passage 97 share the region in the upper part in the first buffer chamber 91. The detouring pressure relief passage 97 and the second pressure relief passage 96 are thus connected to the merging portion 98.

The merging portion 98 is arranged in a region above the second passage 912, which is formed in the vicinity of the first side surface 91*a*. The merging portion 98 is formed in an upper region in the vicinity of the first side surface 92*a* of the second buffer chamber 92 in the first horizontal direction A. Accordingly, the first pressure relief passage 95 and the detouring pressure relief passage 97 are provided below the merging portion 98.

The pressure relief hole 90*b* is arranged in a region above the first passage 911, which is formed in the vicinity of the second side surface 91*b*. The pressure relief hole 90*b* is formed in an upper region in the direction of gravitational force that is in the vicinity of the second side surface 91*b* of the first buffer chamber 91 in the first horizontal direction A.

The pressure relief hole 90*b* and the merging portion 98 are spaced apart from each other in the first horizontal direction A. When the position in the direction of gravitational force is referred to as a height, the height of the merging portion 98 from the oil pan 56 is smaller than the height of the pressure relief hole 90*b* from the oil pan 56. That is, the pressure relief hole 90*b* is arranged at a position diagonally above the merging portion 98. That is, the pressure relief hole 90*b* is arranged above the merging portion 98.

As shown FIG. 4, the second buffer chamber 92 includes a proximal side passage 92*c*, an upper side passage 92*d*, and a stagnation portion 92*e*. The proximal side passage 92*c* is the lower end of the second pressure relief passage 96 and is connected to the upper part of the oil pan 56. The stagnation portion 92*e* is the upper end of the second pressure relief passage 96 and is connected to the communicating passage 93.

The proximal side passage 92*c* extends upward from the oil pan 56. The proximal side passage 92*c* has a first end, which is connected to the oil pan 56. The proximal side passage 92*c* has a second end, which is located above the oil pump 57. A width H5 of the proximal side passage 92*c* in the first horizontal direction A is smaller than the width H3 of the connection passage 90*a*.

The upper side passage 92*d* is connected to the proximal side passage 92*c*. The upper side passage 92*d* extends upward from the second end of the proximal side passage 92*c*. The upper side passage 92*d* has a first end, which is connected to the second end of the proximal side passage 92*c*. The upper side passage 92*d* is formed to extend among the bolts 80 that are not the three bolts 80 used to fix the oil pump 57. A width H6 of the upper side passage 92*d* in the first horizontal direction A is smaller than the width H5 of the proximal side passage 92*c*. The distance in the first horizontal direction A between the bolts 80 on the opposite sides of the upper side passage 92*d* is set such that the cross-sectional area of the upper side passage 92*d* is smaller than the cross-sectional area of the proximal side passage 92*c*.

The stagnation portion 92*e* is connected to the upper side passage 92*d*. The stagnation portion 92*e* is connected to the second end of the upper side passage 92*d*. The stagnation portion 92*e* is formed in the end of the second buffer chamber 92 that is on a side opposite to the oil pan 56. A width H7 of the stagnation portion 92*e* is larger than the width H5 of the proximal side passage 92*c* and the width H6 of the upper side passage 92*d*.

The stagnation portion 92*e* includes a wall surface 92*f*, which is located on a side opposite to the upper side passage 92*d* and intersects with the direction of gravitational force. The wall surface 92*f* extends in the first horizontal direction A. The stagnation portion 92*e* is formed in the upper part of the second buffer chamber 92.

As shown in FIGS. 3 and 4, an upper region of the first buffer chamber 91 in the vicinity of the first side surface 91*a* and a part of the stagnation portion 92*e*, which is an upper region of the second buffer chamber 92 in the vicinity of the first side surface 92*a*, overlap with each other in the axial direction of the low speed shaft 17.

The communicating passage 93 is formed in a part in which the upper regions of the first buffer chamber 91 and the second buffer chamber 92 overlap with each other in the axial direction of the low speed shaft 17. The communicating passage 93 extends in the axial direction of the low speed shaft 17. The communicating passage 93 connects the second buffer chamber 92 and the first buffer chamber 91 to each other on the downstream side in the flowing direction of oil in relation to the wall surface 92*f* of the stagnation portion 92*e*.

Figure 5:
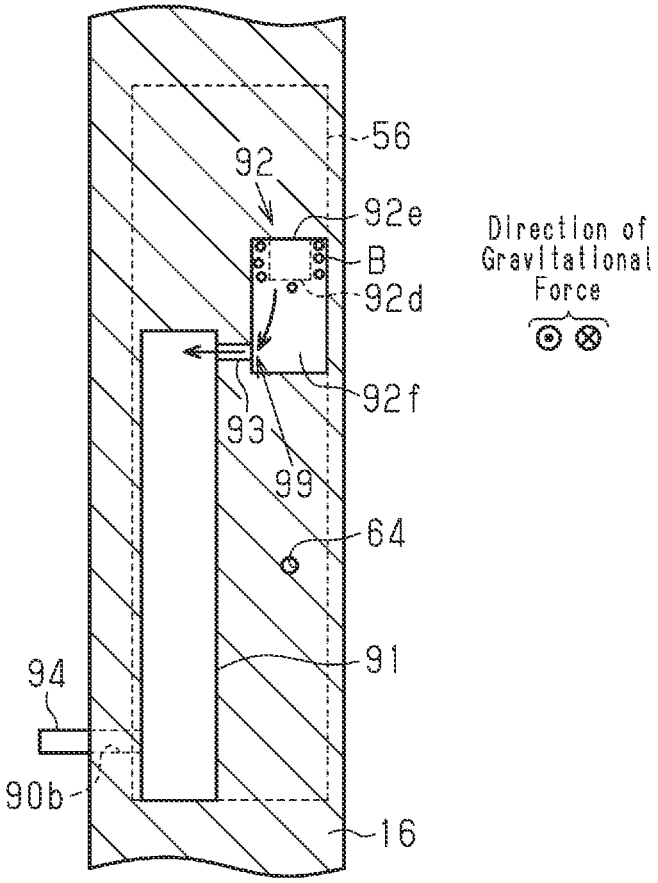
FIG. 5 is a cross-sectional view taken along line 5-5 in FIG. 1.

As shown FIG. 5, the direction in which the second buffer chamber 92 extends and the direction in which the communicating passage 93 extends intersect with each other. The second pressure relief passage 96 thus includes a bent portion 99, in which the direction extending from the oil pan 56 is bent. The bent portion 99 includes the stagnation portion 92*e*. In the bent portion 99, the direction in which oil flows is changed from the direction of gravitational force to the axial direction of the low speed shaft 17.

The cross-sectional areas of the first pressure relief passage 95, the second pressure relief passage 96, and the detouring pressure relief passage 97 in the pressure relief passage 90 will now be described. The cross-sectional areas refer to cross-sectional areas when the passage is cut in a direction perpendicular to the flowing direction of oil.

As shown in FIGS. 3 and 4, in the first pressure relief passage 95, the cross-sectional area of the connection passage 90*a* is smaller than the cross-sectional area of the first passage 911. The cross-sectional areas of the connection passage 90*a* and the first passage 911 are smaller than the cross-sectional area of the region in the first buffer chamber 91 above the protrusion 16*b*. That is, the minimum cross-sectional area of the first pressure relief passage 95 is the cross-sectional area of the connection passage 90*a*.

In the detouring pressure relief passage 97, the cross-sectional area of a passage formed between the protrusion 16*b* and the lower part of the first buffer chamber 91 and the cross-sectional area of a passage formed between the protrusion 16*b* and the first side surface 91*a* are the minimum cross-sectional areas. In the present embodiment, the minimum cross-sectional area of the detouring pressure relief passage 97 is the same as the cross-sectional area of the first passage 911.

In the second pressure relief passage 96, the cross-sectional area of the proximal side passage 92*c* is larger than the cross-sectional area of the upper side passage 92*d*. The cross-sectional areas of the proximal side passage 92*c* and the upper side passage 92*d* are smaller than the cross-sectional area of the stagnation portion 92*e*. The cross-sectional areas of the proximal side passage 92*c* and the upper side passage 92*d* are larger than the cross-sectional area of the communicating passage 93. That is, the largest cross-sectional area of the second pressure relief passage 96 is the cross-sectional area of the stagnation portion 92*e*. The minimum cross-sectional area of the second pressure relief passage 96 is the cross-sectional area of the communicating passage 93. The cross-sectional area of the communicating passage 93 is smaller than the cross-sectional area of the connection passage 90*a*, which is the minimum cross-sectional area of the first pressure relief passage 95. The cross-sectional area of the upper side passage 92*d* is smaller than the cross-sectional areas of the stagnation portion 92*e* and the proximal side passage 92*c*. In the second pressure relief passage 96, the upper side passage 92*d* serves as a constriction.

The cross-sectional area of the stagnation portion 92*e*, which is the largest cross-sectional area of the second pressure relief passage 96, is smaller than the cross-sectional area of the connection passage 90*a*, which is the minimum cross-sectional area of the first pressure relief passage 95. That is, the cross-sectional area of the second pressure relief passage 96 is smaller than the cross-sectional area of the first pressure relief passage 95 over the entire length in the direction of gravitational force. The cross-sectional area of the stagnation portion 92*e*, which is the largest cross-sectional area of the second pressure relief passage 96, is smaller than the cross-sectional area of the second passage 912, which is the minimum cross-sectional area of the detouring pressure relief passage 97.

An operation of the present embodiment will now be described.

As shown in FIG. 1, the oil in the speed increaser chamber 13*c* is stirred by the speed increaser 30. This generates bubbles B in the oil. The bubbles B in the oil generated in the speed increaser chamber 13*c* reach the oil pan 56 through the oil passage 60.

As shown in FIGS. 3 and 4, the bubbles B that have reached the oil pan 56 are retained in the oil pan 56. This raises the level of the oil stored in the oil pan 56. The level of the oil then reaches the first pressure relief passage 95 and the second pressure relief passage 96.

In the present embodiment, the bubbles B of the oil drawn into the second pressure relief passage 96 are crushed by the bent portion 99 when reaching the bent portion 99. When reaching the merging portion 98 from the bent portion 99, oil is returned to the oil pan 56 via the first pressure relief passage 95. When reaching the merging portion 98 from the bent portion 99, gas is discharged to the outside of the housing 11 via the pressure relief hole 90*b*. That is, the oil stored in the oil pan 56 is unlikely to gush out with the bubbles B from the pressure relief hole 90*b*.

The stagnation portion 92*e*, which is formed in the bent portion 99, has the wall surface 92*f*, which intersects with the flowing direction of the oil flowing in the second buffer chamber 92. The oil flowing in the second buffer chamber 92 thus stagnates at the stagnation portion 92*e*. The pressure at the stagnation portion 92*e* is therefore higher than the pressure in a section of the second buffer chamber 92 on the upstream side of the stagnation portion 92*e*. The bubbles B in the oil are thus broken by the pressure at the stagnation portion 92*e*.

The cross-sectional area of the first buffer chamber 91 is larger than the cross-sectional area of the communicating passage 93. Thus, when the bubbles B that have not been removed at the stagnation portion 92*e* reach the first buffer chamber 91, which is larger than the communicating passage 93, via the communicating passage 93, the pressure acting on the bubbles B changes. The bubbles B reaching the first buffer chamber 91 are removed through changes in the pressure.

The present embodiment has the following advantages.

(1) The bubbles B in the oil drawn into the second pressure relief passage 96 are crushed by the bent portion 99 when reaching the bent portion 99. When reaching the merging portion 98 from the bent portion 99, oil is returned to the oil pan 56 via the first pressure relief passage 95. When reaching the merging portion 98 from the bent portion 99, gas is discharged to the outside of the housing 11 via the pressure relief hole 90*b*. That is, the oil stored in the oil pan 56 is unlikely to gush out with the bubbles B from the pressure relief hole 90*b*. This limits a reduction in the amount of oil supplied to the speed increaser 30.

(2) The bubbles B in the oil flowing into the second pressure relief passage 96 reach the first buffer chamber 91 via the bent portion 99 and the merging portion 98. In the present embodiment, the pressure relief hole 90*b* is spaced apart from the bent portion 99 and the merging portion 98. This prevents oil from reaching the pressure relief hole 90*b* from the merging portion 98.

(3) Oil stagnates at the stagnation portion 92*e*. The pressure at the stagnation portion 92*e* is therefore higher than the pressure in a section of the second buffer chamber 92 on the upstream side of the stagnation portion 92*e*. The bubbles B in the oil are thus broken by the pressure at the stagnation portion 92*e*.

When the bubbles B that have not been removed at the stagnation portion 92*e* reach the first buffer chamber 91, which is larger than the communicating passage 93, via the communicating passage 93, the bubbles B in the oil that has reached the first buffer chamber 91 are removed through changes in the pressure. Accordingly, the oil stored in the oil pan 56 is prevented from gushing out with bubbles B from the pressure relief hole 90*b* of the pressure relief passage 90. This limits a reduction in the amount of oil supplied to the speed increaser 30.

(4) The bubbles B in the oil that has reached the stagnation portion 92*e* collide with the wall surface 92*f* of the stagnation portion 92*e*, and disappear when colliding with the wall surface 92*f*.

(5) The cross-sectional flow area of the second pressure relief passage 96 is smaller than the cross-sectional flow area of the first pressure relief passage 95 over the entire length. The bubbles B in the oil stored in the oil pan 56 are thus more likely to be drawn into the second pressure relief passage 96 by capillary action than into the first pressure relief passage 95. The bubbles B in the oil are thus not likely to reach the pressure relief hole 90*b* in the first pressure relief passage 95. This prevents the level of the oil from reaching the atmosphere-side opening of the pressure relief passage 90.

(6) The pressure relief passage 90 includes the detouring pressure relief passage 97. Thus, even if oil reaches the first pressure relief passage 95 in the oil pan 56, and the level of the oil rises to the long-dash short-dash line L1 in FIGS. 3 and 4, the oil is drawn into the detouring pressure relief passage 97. This prevents the level of the oil from reaching the pressure relief hole 90*b* of the pressure relief passage 90.

(7) The bubbles B in the oil flowing into the second pressure relief passage 96 reach the detouring pressure relief passage 97 via the merging portion 98. In the present embodiment, the pressure relief hole 90*b* is spaced apart from the merging portion 98. This prevents oil that has reached the merging portion 98 from reaching the pressure relief hole 90*b*, which is the atmosphere-side opening of the pressure relief passage 90.

(8) The second pressure relief passage 96 has the upper side passage 92*d*, which serves as a constriction. This locally reduces the cross-sectional flow area of the second pressure relief passage 96. The bubbles B in the oil stored in the oil pan 56 thus readily flow toward the second pressure relief passage 96. This further reduces the amount of the bubbles B in the oil flowing into the first pressure relief passage 95. This prevents the level of the oil from reaching the atmosphere-side opening of the pressure relief passage 90.

(9) The pressure relief hole 90*b* is arranged above the merging portion 98. Thus, the oil that has reached the merging portion 98 is returned to the first pressure relief passage 95, which is located below the merging portion 98, and is not likely to reaching the pressure relief hole 90*b*. This prevents the level of the oil from reaching the atmosphere-side opening of the pressure relief passage 90.

(10) The bubbles B in the oil are more likely to flow to the second buffer chamber 92 than to the first buffer chamber 91, and the bubbles B are removed by the stagnation portion 92*e* and the bent portion 99. This prevents oil from leaking from the pressure relief hole 90*b*. Accordingly, the reliability of the centrifugal compressor 10 is improved.

(11) Taking leakage of oil from the pressure relief hole 90*b* into consideration, the centrifugal compressor 10 preferably stores a great amount of oil. In this respect, the present embodiment prevents oil leakage and thus allows for reduction in the total amount of sealed-in oil of the centrifugal compressor 10. This reduces the manufacturing costs of the centrifugal compressor 10.

(12) The pressure relief passage 90 is provided with the ventilation film 90*c*, which allows passage of gas but blocks liquid. The ventilation film 90*c* prevents foreign matter and water from entering the centrifugal compressor 10 from the outside through the pressure relief passage 90.

(13) Since the bubbles B in the oil are prevented from reaching the pressure relief hole 90*b*, the ventilation film 90*c* is prevented from being clogged.

The above-described embodiment may be changed as described below. The above-described embodiment and the following modifications can be combined as long as the combined modifications remain technically consistent with each other.

The oil pan 56, the oil pump 57, the oil passage 60, the first buffer chamber 91, and the second buffer chamber 92 may be formed in the motor housing member 12 without fastening the rear housing member 16 to the motor housing member 12 with the bolts 80.

The pressure relief hole 90*b* may be arranged above the second passage 912. In this case, the pressure relief hole 90*b* is arranged above the merging portion 98.

In the above-described embodiment, the connection passage 90*a* and the first buffer chamber 91 are displaced from the second buffer chamber 92 in the axial direction of the low speed shaft 17, and the second buffer chamber 92 is arranged between the first buffer chamber 91 and the motor housing member 12 in the axial direction of the low speed shaft 17. However, the present disclosure is not limited to this. For example, the connection passage 90*a* may be located at the same position in the axial direction of the low speed shaft 17 as the first buffer chamber 91 and the second buffer chamber 92. In this case, the communicating passage 93 may be changed to extend in the first horizontal direction A, and the first buffer chamber 91 and the second buffer chamber 92 may be connected to each other.

The connection passage 90*a* may be inclined with respect to the direction of gravitational force, as long as the connection passage 90*a* connects the oil pan 56 and the first buffer chamber 91 to each other.

The wall surface 92*f* of the stagnation portion 92*e* extends in the first horizontal direction A in the above-described embodiment. However, the wall surface 92*f* may be inclined to intersect with the direction of gravitational force.

The second buffer chamber 92 extends upward from the oil pan 56 in the above-described embodiment. However, the second buffer chamber 92 may extend in a direction intersecting with the direction of gravitational force. In this case, the wall surface 92*f* of the stagnation portion 92*e* simply needs to be arranged to intersect with the direction in which oil flows in the second buffer chamber 92.

The width H1 of the first buffer chamber 91 and the width H2 of the second buffer chamber 92 are the same in the above-described embodiment. However, the widths H1 and H2 may be different from each other. The widths H1, H2 may be changed as long as the cross-sectional flow area of the second pressure relief passage 96 is smaller than the cross-sectional flow area of the first pressure relief passage 95 over the entire length. The same change may be made to the above-described modifications.

The proximal side passage 92*c* has the second end, which is located above the oil pump 57, in the above-described embodiment. However, the second end may be located below the oil pump 57. In this case, the first end of the upper side passage 92*d* may extend to the second end of the proximal side passage 92*c*.

The second buffer chamber 92 may be changed to connect the proximal side passage 92*c* directly to the stagnation portion 92*e*.

The centrifugal compressor 10 may be employed in any suitable application to compress any type of gas. For example, the centrifugal compressor 10 may be employed in an air conditioner to compress refrigerant gas. Further, the centrifugal compressor 10 may be mounted on any structure other than a vehicle.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A centrifugal compressor, comprising:

a low speed shaft that is rotated by a drive source;

an impeller that is attached to a high speed shaft, which rotates at a speed higher than a speed of the low speed shaft;

a speed increaser that transmits power of the low speed shaft to the high speed shaft;

a housing that includes a drive source chamber that accommodates the drive source, an impeller chamber that accommodates the impeller, a speed increaser chamber that accommodates the speed increaser, and a dividing wall having an insertion hole through which the high speed shaft is passed, the dividing wall dividing the impeller chamber and the speed increaser chamber from each other;

a seal member provided between an outer circumferential surface of the high speed shaft and an inner circumferential surface of the insertion hole;

an oil pan that stores oil supplied to the speed increaser;

an oil passage that supplies oil stored in the oil pan to the speed increaser, and returns the oil to the oil pan; and a pressure relief passage that connects the oil pan to a pressure relief hole that opens in an outer surface of the housing, wherein the pressure relief passage includes a first pressure relief passage and a second pressure relief passage that extend from the oil pan in a branching manner, the second pressure relief passage merges with the first pressure relief passage to form a merging portion, the pressure relief hole is arranged above the merging portion in a direction of gravitational force, the first pressure relief passage is arranged below the merging portion in the direction of gravitational force, a minimum cross-sectional area of the second pressure relief passage is smaller than a minimum cross-sectional area of the first pressure relief passage, the second pressure relief passage includes a bent portion formed by bending the second pressure relief passage, the bent portion being configured to perform gas/liquid separation by crushing bubbles, when reaching the merging portion from the bent portion, oil is returned to the oil pan via the first pressure relief passage, and when reaching the merging portion from the bent portion, gas is discharged to an outside of the housing via the pressure relief hole.

2. The centrifugal compressor according to claim 1, wherein among horizontal directions, a direction that is perpendicular to an axis of the low speed shaft is defined as a first horizontal direction, the first pressure relief passage includes a first buffer chamber in the housing, the housing includes a first side surface and a second side surface that are opposed to each other in the first horizontal direction, the first buffer chamber is defined by the first side surface and the second side surface, the bent portion is formed in a vicinity of the first side surface of the first buffer chamber in the first horizontal direction and in an upper region in the direction of gravitational force, and the pressure relief hole is formed in a vicinity of the second side surface of the first buffer chamber in the first horizontal direction and in an upper region in the direction of gravitational force.

3. The centrifugal compressor according to claim 2, wherein the second pressure relief passage includes a second buffer chamber and a communicating passage in the housing, the housing includes a first side surface and a second side surface that are opposed to each other in the first horizontal direction, the second buffer chamber is defined by the first side surface and the second side surface, and the second pressure relief passage is connected to the first buffer chamber by the communicating passage.

4. The centrifugal compressor according to claim 3, wherein the merging portion is a connection portion at which the first buffer chamber and the communicating passage are connected to each other.

5. The centrifugal compressor according to claim 3, wherein the second buffer chamber includes a proximal side passage that is connected to the oil pan, and an upper side passage that is connected to the proximal side passage, and a width of the upper side passage in the first horizontal direction is smaller than a width of the proximal side passage.

6. The centrifugal compressor according to claim 2, wherein a protrusion through which the low speed shaft is passed is provided in the first buffer chamber, a first passage and a second passage are formed in the first buffer chamber, the first passage is formed between the protrusion and the second side surface, the second passage includes a passage formed between the protrusion and a lower part of the first buffer chamber, and a passage formed between the protrusion and the first side surface, and a detouring pressure relief passage is formed by the second passage and a region in the first buffer chamber that is above the protrusion.

* * * * *